US005306761A

United States Patent [19]

Ohwaki et al.

[11] Patent Number: 5,306,761

[45] Date of Patent: Apr. 26, 1994

[54] HYGROSCOPIC POLYAMIDE FIBER

[75] Inventors: Shinji Ohwaki, Minoo; Ryoichi Yamazaki, Kyoto; Masato Yoshimoto, Ibaraki, all of Japan

[73] Assignee: Teijin Limited, Osaka, Japan

[21] Appl. No.: 980,723

[22] Filed: Nov. 24, 1992

[30] Foreign Application Priority Data

Nov. 25, 1991 [JP] Japan ..... 3-334535

[51] Int. Cl.[5] ..... C08L 77/00

[52] U.S. Cl. ..... 524/434; 521/61; 521/62; 521/63; 521/184; 521/189; 524/420; 528/499

[58] Field of Search ..... 524/434, 420; 528/499; 521/61, 62, 63, 184, 189

[56] References Cited

U.S. PATENT DOCUMENTS 4,873,296 10/1989 Ciaperoni et al. ..... 525/434

FOREIGN PATENT DOCUMENTS 4-289226 10/1992 Japan .

OTHER PUBLICATIONS

"Hydrophilic Nylon for Improved Apparel Comfort", R. A. Lofquist, et al., Textile Research Journal, Jun. 1985, pp. 325–333.

*Primary Examiner*—Harold D. Anderson

*Attorney, Agent, or Firm*—Armstrong, Westerman, Hattori, McLeland & Naughton

[57] ABSTRACT

A polyamide fiber comprised of (A) a thermoplastic aliphatic polyamide having copolymerized therein a polyalkylene oxide unit and having a melting point of at least 160° C., and (B) a polyoxyalkylene glycol, wherein the ingredient (B) is finely dispersed in the ingredient (A). A polyamide fiber exhibiting a rate of moisture absorption of at least 3.5%/5 minutes at 25° C. and R.H. 90% and/or a triboelectric voltage of not larger than 1.5 kV at 20° C. and R.H. 40% is obtained by removing the ingredient (B) from the above-mentioned polyamide fiber by means of dissolution.

4 Claims, No Drawings

HYGROSCOPIC POLYAMIDE FIBER

BACKGROUND OF THE INVENTION (1) Field of the Invention

This invention relates to a polyamide fiber which is used for making a polyamide fiber having an improved moisture absorption and/or antistatic property, and for making a fabric having an improved moisture absorption, antistatic property and feeling.

Fabrics such as woven and knitted fabrics made from the polyamide fiber of the invention are valuable especially as clothes for summer wear and sport wear, for which a high hygroscopicity is required, and as clothes for underwear and lining cloth, for which antistatic property is required.

(2) Description of the Related Art

Conventional polyamide fibers (hereinafter may be called as "nylon fibers") have characteristics such as high tenacity, softness and pile stability against compression, and hence, have been widely used for stockings, carpets, sport wear and underwear. Nevertheless, clothes of polyamide fibers are not satisfactory in moisture absorption, although their moisture absorption is better than those of polyester fibers and acrylic fibers. Namely. it is said that sport wear and summer wear get readily humid and an improvement in comfortableness is eagerly desired. Further, polyamide fibers have a poor antistatic property, and hence, underwear stimulates the skin and, when taken off, it makes a sparkling sound due to electrical discharge. Thus, an improvement in antistatic property also is eagerly desired.

With regard to feeling of clothes, a weight-reduction treatment using an alkali is popularly carried out on polyester woven and knitted fabrics to enhance the bounce resilience, suppleness and drapability and to provide a variety of polyester fiber fabrics of different feelings. In sharp contrast, an alkali-treatment cannot be employed in polyamide woven and knitted fabrics. Although an acid treatment can be theoretically applied to polyamide fabrics, the acid treatment is of little or no practical use because problems arise such that an acid is usually toxic to a certain extent and causes corrosion of apparatuses. Therefore, there is no practical method of giving a variety of feelings to polyamide woven and knitted fabrics.

An attempt has heretofore been made to improve the moisture absorption of polyamide fibers by imparting a hygroscopicity-enhancing agent to the fiber surfaces by an after-treatment. However, the application of a hygroscopicity-enhancing agent has problems such that the fastness to washing is poor and, when the amount of the hygroscopicity-enhancing agent is increased to improve hygroscopicity, the undesirable waxy hand increases.

Further, a proposal has been made to graft-copolymerizing an acrylic acid onto a polyamide and then neutralizing the thus-obtained graft-copolymer to introduce a sodium carboxylate group (—COONa) into the copolymer. This proposal has problems such that a high percentage of graft copolymerization and thus a desired high hygroscopicity are difficult to obtain, or, even though a high degree of graft copolymerization can be obtained, the waxy hand increases to a considerable extent.

Another proposal has been made to render a polyamide itself hydrophilic, for example, by copolymerizing polyamide-forming monomers with a polyoxyalkylene glycol or other hydrophilic ingredients (Textile Research Journal 55, 325–333 [1985]). A high copolymerization ratio of the hydrophilic ingredient is required for a desired high hygroscopicity, but it leads to reduction of mechanical properties and light resistance and appearance of waxy hand.

Thus, attempts for imparting polyamide fibers a good hygroscopicity solely by a chemical modification of a polyamide have been unsuccessful. Still another proposal has been made wherein a polyamide is combined with a high hygroscopicity-giving polymer so that the desired properties of the two polymers manifest themselves. For example, a core-sheath type conjugate fiber comprised of a highly hygroscopic polyamide core and a lowly hygroscopic polyamide sheath is described in Unexamined Japanese Patent Publication No. H3-213519. This conjugate fiber is costly because a complicated manufacturing apparatus must be used. Further, it is difficult to keep the cross-sectional shape constant over a long period of time in the fiber-making step, and hence, a dyeing speck and streaks are liable to appear in woven fabrics and knitted fabrics made therefrom. Further, the two polyamides for the composite fiber usually have different melting points and the melt spinning thereof must be carried out at a temperature higher than the melting point of the polyamide having a higher melting point than that of the other polyamide. At the high temperature melt spinning, the polyamide of a lower melting point is liable to be thermally degraded and the spinnability is lowered.

As a further proposal of imparting a good hygroscopicity to a polyamide, a physical modification process has been proposed wherein a soluble ingredient is incorporated in a polyamide, the mixed polyamide is spun into a fiber and then the soluble ingredient is extracted with a water or another solvent from the fiber to increase the moisture-absorbing surface area of the fiber whereby a polyamide fiber exhibiting an enhanced moisture absorption and rate of moisture absorption is obtained. However, if the amount of the soluble ingredient is small, the hygroscopicity of the fiber obtained is insufficient. In contrast, if the amount of the soluble ingredient is large, the mechanical properties of the fiber are lowered and, when clothes thereof are worn, they are subject to whitening and fibrillation. Thus, the hygroscopicity and the mechanical properties are incompatible with each other.

To impart an antistatic property to a polyamide fiber, a proposal has been made wherein an antistatic agent comprising a hydrophilic ingredient such as polyoxyalkylene glycol and an ionic ingredient such as an alkylsulfonic acid metal salt, a benzenesulfonic acid metal salt or a higher fatty acid metal salt is incorporated in a polyamide fiber. A large amount of the antistatic agent must be added for the antistatic property of a desired level. But, the incorporation of a large amount of the antistatic agent leads to lowering of the spinnability and the mechanical properties of fiber, and, when worn, the clothes are subject to whitening and fibrillation. Thus, the antistatic property is incompatible with the spinnability and the mechanical properties.

SUMMARY OF THE INVENTION

In view of the foregoing, an object of the invention is to provide a functional polyamide fiber having improved hygroscopicity and antistatic property as well as good mechanical properties and anti-fibrillating property, and capable of providing a fabric exhibiting no waxy hand and having good wearing characteristics.

Another object of the invention is to provide a polyamide fabric of good performances, for which a weight-reduction treatment can be employed and which are valuable as a material for clothes having various feelings.

In one aspect of the invention, there is provided a polyamide fiber comprising:

(A) a thermoplastic aliphatic polyamide having copolymerized therein a polyalkylene oxide unit and having a melting point of at least 160° C., and (B) a polyoxyalkylene glycol, said ingredient (B) being finely dispersed in the ingredient (A).

In another aspect of the invention, there is provided a hygroscopic polyamide fiber exhibiting a rate of moisture absorption of at least 3.5%/5 minutes at a temperature of 25° C. and a relative humidity of 90%, said polyamide fiber being made by removing at least a part of the ingredient (B) from the fiber by means of dissolution.

In still another aspect of the invention, there is provided an antistatic polyamide fiber exhibiting a frictional electrification voltage of not larger than 1.5 kV at a temperature of 20° C. and a relative humidity of 40%, said polyamide fiber being made by removing at least a part of the ingredient (B) from the fiber by means of dissolution.

In a further aspect of the invention, there is provided a process for making a polyamide fabric having a good feeling which comprises the steps of:

finely dispersing (B) a polyoxyalkylene glycol in (A) a thermoplastic aliphatic polyamide having a polyalkylene oxide unit copolymerized therein and having a melting point of at least 160° C., melt-spinning the thus-obtained mixture into a fiber, making a fabric from the fiber, removing at least a part of the ingredient (B) from the fiber by means of dissolution.

DESCRIPTION OF THE PREFERRED EMBODIMENTS

The thermoplastic aliphatic polyamide (hereinafter may be abbreviated to "polyamide (A)") constituting the polyamide fiber of the invention has a melting point of at least 160° C., preferably at least 170° C. and more preferably at least 200° C. The polyamide fiber of the invention is usually subjected to a heat-setting step such as pre-heat-setting or final heat-setting and a scouring or dyeing step, after made into a fabric such as a woven fabric or a knitted fabric. The heat-setting step is carried out usually at a temperature of at least 160° C., e.g., 160° to 170° C. in the air. Further, clothes of the fabric are ironed out usually at a temperature of at least 160° C. for wearing. Therefore, if the polyamide (A) has a melting point below 160° C., then the fibrils and voids formed by the removal of the polyoxyalkylene glycol (B) from the fiber are melt-adhered and collapsed and thus the intended large inside surface area of the fiber and the desired hygroscopicity and antistatic property cannot be obtained.

It is essential that a polyalkylene oxide unit is copolymerized in the polyamide (A) because the copolymerized polyalkylene oxide unit assists the dispersion of the polyoxyalkylene glycol (B) in the polyamide (A) to form a very fine dispersion. Therefore, when at least a part of the ingredient (B) is removed by dissolution in a solvent such as hot water, a very large inside surface area is formed within the fiber and good hygroscopicity, anti-fibrillation property and antistatic property can be obtained.

The copolymerized polyalkylene oxide unit is formed by copolymerizing polyamide-forming monomers with a polyoxyalkylene glycol or a derivative thereof prepared by modifying the termial hydroxyl group or groups of a polyoxyalkylene glycol with, e.g., an amino group or a carboxyl group. As the polyoxyalkylene glycol, there can be mentioned, for example, polyethylene glycol, polypropylene glycol and polyethylene/-propylene glycol. Of these, polyoxyethylene unit-forming monomers, i.e., polyethylene glycol and derivatives thereof are preferable. As specific examples of the polyamide (A) having the polyalkylene oxide unit copolymerized therein, there can be mentioned a polyoxyethylene glycol-copolymerized polycaprolactam, a carboxyl-terminated polyoxyethylene glycol-copolymerized polyhexamethylene adipamide and an amino-terminated polyoxyethylene glycol-copolymerized polybutyrolactam and modified polyamides thereof which are prepared by substituting a methoxymethyl group for a part of hydrogens in the amide bond.

The polyalkylene oxide unit to be copolymerized preferably has a number average molecular weight of 2,000 to 8,000, more preferably 4,000 to 6,000. If the number average molecular weight of the polyalkylene oxide unit is lower than 2,000, a good hygroscopicity can be obtained only with a high copolymerization ratio of the polyalkylene oxide unit. But, the high copolymerization ratio invites lowering of the melting point of the polyamide (A) and the thermal resistance of the fiber. If the number average molecular weight of the polyalkylene oxide unit exceeds 8,000, the compatibility of the polyalkylene oxide unit with the polyamide (A) becomes poor, and thus, the copolymerized polyamide is difficult to obtain and the fine dispersion of the polyoxyalkylene glycol (B) is difficult to obtain. The amount of the polyalkylene oxide unit is preferably 3 to 15% by weight, more preferably 6 to 12% by weight, based on the weight of the polyamide into which the polyalkylene oxide unit is to be copolymerized. Outside this range, the dispersion of the polyoxyalkylene glycol is insufficient or the thermal resistance of the polyamide (A) is poor.

The polyoxyalkylene glycol (B) to be incorporated in the polyamide (A) preferably has a number average molecular weight of 6,000 to 20,000, preferably 8,000 to 15,000. If the number average molecular weight of (B) is lower than 6,000, the compatibility of (B) with the polyamide (A) is too large to form a fine dispersion, and the polyoxyalkylene glycol (B) reacts with a part of the polyamide (A), thereby lowering the thermal resistance of the polyamide (A) and melt-adhering the fibrils and collapsing the voids, with the result of reduction of hygroscopicity and antistatic property. If the number average molecular weight of (B) exceeds 20,000, the compatibility of the (B) with the polyamide (A) is lowered, and thus, the dispersion state of (B) and the spinnability become worse and the fine fibrils and voids are difficult to obtain, also with the result of reduction of hygroscopicity and antistatic property.

As specific examples of the polyoxyalkylene glycol (B), there can be mentioned those which are recited with regard to the polyoxyalkylene glycols used for the copolymerization in the polyamide (A).

The amount of the polyoxyalkylene glycol (B) is preferably 5 to 40% by weight, based on the weight of the copolyamide (A). If the amount of (B) is lower than 5% by weight, a sufficient amount of voids are not formed, and in contrast, if the amount of (B) exceeds 40% by weight, the amount of voids is too large and the anti-fibrillating property and mechanical property of the fiber are deteriorated.

Conventional additives, which are added to a fiber-forming polymeric material, such as a flame retardant, an antioxidant, a delustrant and a pigment, can be added to the polyamide (A) and/or the polyoxyalkylene glycol (B).

The fine dispersion of the polyoxyalkylene glycol (B) in the polyamide (A) can be effected in a usual manner by using, for example, an extruder or kneader. The thus-obtained mixture of (A) with (B) can be melt-spun into a fiber and the fiber can be drawn and/or heat-treated, by conventional procedures.

A polyamide fiber having an enhanced hygroscopicity and antistatic property is made by removing the polyoxyalkylene glycol (B) from the polyamide fiber of the invention by means of dissolution of (B) in water or another solvent. The manner in which the polyoxyalkylene glycol (B) is removed is not particularly limited. The polyoxyalkylene glycol (B) can easily be removed by immersing in hot water, preferably in boiling water. The immersion in hot water can be carried out either before or after the fiber is woven or knitted into a fabric. Preferably, the hot water immersion is carried out simultaneously with scouring, after the fiber is woven or knitted into a fabric.

Polyamide fibers are generally subjected to a heat-treatment such as pre-heat-setting or final heat-setting in the air at a temperature of, e.g., 160° to 170° C., or such as scouring or dyeing in an aqueous bath at a temperature of, e.g., at least 70° C., after the fibers are woven or knitted into fabrics. When heat-treated, the polyamide fibers are partially plasticized, and the fibril diameter and the void diameter are reduced. This fact can easily be confirmed by measuring the fibril diameter and the void diameter by an electron microscope after the polyoxyalkylene glycol (B) is removed from the fibers by dissolution at a temperature as low as possible and after the fibers are further heat-treated.

Surprisingly, it now has been found that the rate of moisture absorption and antistatic property of the heat-set or dyed or scoured polyamide fibers are enhanced as compared with those of the polyamide fibers as measured immediately after the polyoxyalkylene glycol (B) is removed by dissolution.

Further, with regard to the fiber diameter, it now has been found that there is no great difference between (a) the fiber diameter as measured before the polyamide fiber of the invention is woven or knitted into a fabric and (b) the fiber diameter as measured after the polyoxyalkylene (B) is removed from the polyamide fiber of the invention at a temperature as low as possible. But, (c) the fiber diameter as measured after the polyamide fiber is subjected to a heat-treatment such as heat-setting or dyeing or scouring is much smaller than the above-mentioned (a) and (b). In other words, the fiber diameter and fibril diameter are greatly reduced by the heat-setting or dyeing or scouring.

More specifically, the polyamide fiber from which the polyoxyalkylene glycol (B) has been removed is subjected to a heat-treatment such as heat-setting in the air at a temperature of at least 120° C., preferably at least 130° C. and/or such as dyeing in an aqueous bath at a temperature of at least 70° C., preferably at least 80° C. The heat-treatment may be carried out as a special step solely for reducing the fibril diameter and the fiber diameter. By the heat treatment, the fibril diameter and the fiber diameter are reduced whereby the hygroscopicity, antistatic property and feeling of the woven or knitted fabric are improved. However, if the heat-treating temperature is too high, the fiber is plasticized and occasionally partially melted, and the fibrils are melt-adhered and the voids are collapsed, which lead to drastic reduction of the hygroscopicity and antistatic property. Therefore, the heat-treatment of the polyamide fiber and/or fabric must be carried out at a temperture below the melting point, usually at a temperature not higher than 200° C., and is preferably carried out at a temperature not higher than 170° C.

A typical polyamide fiber obtained by the removal of at least a part of the polyoxyalkylene glycol (B) is characterized as exhibiting a rate of moisture absorption of at least 3.5%/5 minutes at a temperature of 25° C. and a relative humidity of 90%. Under conditions such as a temperature of 25° C. and a relative humidity of 90%, a human is wet with perspiration. If the rate of moisture absorption of the fiber is lower than 3.5%/5 minutes, the perspiration is not satisfactorily absorbed, the clothes are clammy to the skin and not comfortable to wear. In contrast, if the rate of moisture absorption of the fiber is at least 3.5%/5 minutes, the perspiration is rapidly absorbed and the absorbed perspiration is spread over a broad area of the clothes. Therefore, the perspiration is readily evaporated and the temperature rise of human body can be avoided.

The rate of moisture absorption used herein is determined as follows. The fiber or fabric is dried in a drier maintained at a temperature of 105° C. for 3 hours and the absolute dry weight ($W_1$) is measured. Then the dried fiber or fabric is placed under conditions of a temperature of 25° C. and a relative humidity of 90% and, 5 minutes later, the weight ($W_2$) is measured. The rate of moisture absorption (M) is expressed by the following equation.

$$M(\%)=[(W_2-W_1)/W_1]\times 100$$

A typical polyamide fiber obtained by the removal of at least a part of the polyoxyalkylene glycol (B) is characterized as exhibiting a triboelectric voltage of not larger than 1.5 kV at a temperature of 20° C. and a relative humidity of 40%. When the triboelectric voltage is not larger than 1.5 kV, clothes made from the fiber are not clinging to the body when worn, and they do not make a sparkling sound and do not stimulate the skin when taken off.

The triboelectric voltage used herein is determined as follows. A dyed fabric is subjected to washing thirty times according to Japanese Indusrial Standard (JIS) L-1018-77 6.36 and then the fabric is subjected to conditioning at a relative humidity of 40%+2% in a desiccator over a period of at least 24 hours to prepare a sample fabric. The triboelectric voltage is measured at a temperature of 20° C.+2° C. and a relative humidity of 40%+2% by using a rotary static tester (Kyoto University Kaken-type) according to JIS L1094 8.2B.

The features and advantages of the polyamide fiber and fabric made by removing at least a part of the polyoxyalkylene glycol (B) from the polyamide fiber of the invention will be described.

It is said that, when two kinds of polymers having a relatively good compatibility with each other are subjected to mixed spinning to form a fine dispersion wherein one polymer as the independent phase is finely dispersed in the other polymer as the continuous phase, it is very difficult to remove the independent phase by dissolution thereof. However, in the case of the polyamide fiber of the invention wherein the polyoxyalkylene glycol (B) is finely dispersed in the polyamide (A) having copolymerized therein a polyalkylene oxide unit, the ingredient (B) can easily be removed by dissolution and a fiber having fine fibrils and fine voids is obtained.

When the polyamide fiber obtained by the removal of the ingredient (B) is subjected to a heat-treatment such as heat-setting or dyeing or scouring, before or after the fiber is woven or knitted into a fabric, the fibril diameter and the void diameter are reduced, and hence, moisture easily condenses into water due to capillary action whereby the hygroscopicity and antistatic property are further enhanced. Further, when the removal of the ingredient (B) from the polyamide fiber of the invention and the heat-treatment of the fiber are carried out after the fiber is woven or knitted into a fabric, the fiber diameter is reduced and a fabric having an improved feeling is obtained.

More specifically, if two kinds of polymers having a poor compatibility with each other are mixed together, the mixture is spun into a fiber and then one of the polymers is removed by dissolution, the inside surface area of the fiber increases due to the dissolution of the polymer, and the moisture absorption is increased. However, this moisture absorption occurs only due to the surface adsorption, and therefore, the moisture absorption is not large, and the fiber is readily broken and has a poor antifibrillation property.

In sharp contrast, in the polyamide fiber of the invention, the polyoxyalkylene glycol (B) has a good compatibility with and is finely dispersed in the polyamide (A) having copolymerized therein a polyalkylene oxide unit. When (B) is removed, a fiber having fine fibrils and fine voids is obtained. This fiber has an equilibrium moisture content larger than that calculated merely from the chemical composition. It is presumed that the polyoxyalkylene glycol left on the surfaces of fine voids and within the polyamide has a large surface area and thus the interaction between the polyoxyalkylene glycol and water is large. Further, moisture condensation due to a capillary action occurs in the fine fibrils and fine voids and thus the moisture absorption is enhanced. Especially, when the fiber is further subjected to a heat-treatment, the fibril diameter and the void diameter are reduced and therefore, the moisture condensation due to a capillary action is greatly enhanced. The rate of moisture absorption and the antistatic property also are enhanced.

The reduced fibril diameter and void diameter minimize undesirable splitting of the fiber and thus the anti-fibrillation property is not deteriorated.

The enhancement of the hygroscopicity achieved by the invention is very large, and therefore, when a so large hygroscopicity is not desired, the amount of the polyalkylene oxide unit copolymerized in the polyamide (A) and the amount of the polyoxyalkylene glycol (B) can be reduced and hence good thermal resistance and mechanical properties are obtained.

Further, the fiber made by the removal of the polyoxyalkylene glycol has fine streaky irregularities on the surface, i.e., a rough surface and hence a fabric having a dry touch which is useful as summer wear can be obtained.

When the removal of the polyoxyalkylene glycol is carried out after the fiber is woven or knitted into a fabric, and especially when the fabric is subjected to a heat treatment, the contact among individual fibers is reduced by the reduction of the fiber diameter, and consequently, a fabric having an enhanced pile stability against compression and bounce resilience can be obtained.

The invention will now be described by the following examples that by no means limit the scope of the invention. In the examples, the properties of the fiber and fabric were determined as follows.

(1) Rate of Moisture Absorption

The rate of moisture absorption is determined by the procedure hereinbefore described. A knitted fabric is used as the sample in the working examples.

(2) Equilibrium Moisture Content

The absolute dry weight ($W_1$) of a knitted fabric is measured in a manner similar to that described in the procedure for the determination of the rate of moisture absorption (M), and then the fabric is placed under conditions of a temperature of 25° C. and a relative humidity of 90% and, when the weight of the fabric becomes constant, the weight ($W_3$) is measured. The equilibrium moisture content (E) is calculated from the following equation.

$$E(\%)=[(W_3-W_1)/W_1]\times 100$$

(3) Antistatic Property

The antistatic property is expressed by the triboelectric voltage which is determined by the procedure described above.

(4) Anti-fibrillation Property

The anti-fibrillation property was evaluated according to JIS L-0849 (method of determining color fastness to rubbing). A strip sample having a size of about 22 cm length×3 cm width is cut from a plain weave fabric in a manner such that the longitudinal direction of the sample is in agreement with the warp of the fabric. A white cotton cloth having a size of about 5 cm×5 cm is used as the abraiding cloth. A type II rubbing tester was used. The tip of the rubbing element is loaded with a weight of 500 g and is covered with the dry cotton abrading cloth. The strip sample is fixed on a rest and the abrading cloth is reciprocated at a stroke of 10 cm on the strip sample at a rate of 30 reciprocations per minute. After 500 reciprocations, the fibrillated state is observed.

The results are expressed by the following five ratings.

Rating 1: greatly fibrillated
2: fairly fibrillated
3: slightly fibrillated
4: very few fibrils are found
5: no fibril is found The ratings 3, 4 and 5 are acceptable.

(5) Fiber Diameter Reduction and Feeling

The fiber diameter is measured by using an electron microscope. The reduction of the fiber diameter is calculated from the following equation.

Fiber Diameter Reduction $(\%)=[(D_1-D_2)/D_1]\times 100$ where $D_1$ is diameter of fiber as measured immediately after a fabric is made, and $D_2$ is diameter of fiber as measured after the fabric is dyed.

The feeling of the fabric was evaluated by the pile stability against compression, bounce resilience and drapability thereof.

EXAMPLES 1 to 4 and COMPARATIVE EXAMPLES 1 to 4

As the polyamide (A), a copolyamide copolymerized from ε-caprolactam and 8% by weight, based on the ε-caprolactam, of polyethylene glycol having a number average molecular weight of 4,000, both terminals of which were modified to a carboxyl group, was used. This copolyamide had an intrinsic viscosity of 0.955 as measured at 35° C. in meta-cresol. As the polyoxyalkylene glycol (B), polyethylene glycols having the number average molecular weights shown in Table 1 and containing 10% by weight of an antioxidant (Irganox 1010 supplied by Ciba-Geigy) were used in the added amounts shown in Table 1. The copolyamide and the polyethylene glycol were mixed in a molten state by using a twin-screw extruder and made into a chip.

The chip was melt-spun through a spinneret having orifices of a round shape and having a diameter of 0.2 mm into filaments and the filaments were drawn and heat-treated by a conventional procedure to obtain a drawn filament yarn of 74 denier composed of 24 filaments.

The drawn filament yarn was woven into a plain weave fabric. The fabric was immersed in boiling water for 10 minutes whereby the polyethylene glycol was dissolved and removed. The dissolution percentage of the polyethylene glycol is shown in Table 1. Then the fabric was subjected to dyeing involving the use of a bath of boiling water for 45 minutes, and thereafter, subjected to heat-setting at 170° C. for 45 seconds.

The hygroscopic characteristics, antistatic property, anti-fibrillation property and feeling of the dyed fabric were evaluated. The results are shown in Table 2.

COMPARATIVE EXAMPLES 5 to 8

By substantially the same procedure as described in the above examples, dyed fabrics were made wherein, as the polyamide (A), a poly-ε-caprolactam into which a polyethylene oxide unit was not copolymerized was used instead of the copolyamide. The results are shown in Tables 1 and 2.

TABLE 1

| Example and Comparative Example | Polyamide (A) | Polyoxyalkylene glycol (B) Kind | Amount (wt. %) | Dissolution % of polyoxyalkylene glycol (B) |
|---|---|---|---|---|
| Comp. Ex. 1 | Mod. Nylon 6 | — | — | — |
| Comp. Ex. 2 | Mod. Nylon 6 | PEG 5000 | 15 | 3.8 |
| Example 1 | Mod. Nylon 6 | PEG 10000 | 15 | 12.3 |
| Comp. Ex. 3 | Mod. Nylon 6 | PEG 25000 | 15 | 14.1 |
| Example 2 | Mod. Nylon 6 | PEG 10000 | 10 | 6.7 |
| Example 3 | Mod. Nylon 6 | PEG 10000 | 20 | 16.5 |
| Example 4 | Mod. Nylon 6 | PEG 10000 | 30 | 28.4 |
| Comp. Ex. 4 | Mod. Nylon 6 | PEG 10000 | 45 | 38.9 |
| Comp. Ex. 5 | Nylon 6 | — | — | — |
| Comp. Ex. 6 | Nylon 6 | PEG 5000 | 15 | 14.0 |
| Comp. Ex. 7 | Nylon 6 | PEG 10000 | 15 | 14.5 |
| Comp. Ex. 8 | Nylon 6 | PEG 25000 | 15 | 14.9 |

Note Mod. Nylon 6: Copolyamide (Nylon 6) having copolymerized therein 8 wt. % of a polyethylene oxide unit
PEG: Polyethylene glycol (numeral indicates number average molecular weight)

TABLE 2

| Example and Comparative Example | Absorption property Rate*4 (%/5 m) | Equi. (%)*5 | Triboelectric voltage (V) | Anti-fibrillation (rating) | Fiber diameter reduction (%) | Feeling of fabric |
|---|---|---|---|---|---|---|
| Comp. Ex. 1 | 3.2 | 11.9 | 4500 | 5 | 0 | Poor *2 |
| Comp. Ex.2 | 3.2 | 14.3 | 3200 | 4 | 0.4 | Poor *2 |
| Example 1 | 4.5 | 14.0 | 1450 | 4 | 3.7 | Good |
| Comp. Ex. 3 | 3.0 | 12.0 | 2000 | 2 | 4.5 | Poor *3 |
| Example 2 | 4.3 | 14.9 | 1490 | 4 | 1.9 | F. good |
| Example 3 | 4.6 | 13.1 | 1030 | 4 | 9.3 | V. good |
| Example 4 | 5.2 | 12.9 | 650 | 3 | 12.7 | V. good |
| Comp. Ex. 4 | 6.5 | 12.5 | 600 | 2 | 18.6 | Poor *3 |
| Comp. Ex. 5 | 2.7 | 7.7 | 5300 | 5 | 0.2 | Poor *2 |
| Comp. Ex. 6 | 2.7 | 8.3 | 3500 | 2 | 4.6 | Poor *3 |
| Comp. Ex. 7 | 3.3 | 8.5 | 2010 | 1 | 4.5 | Poor *3 |
| Comp. Ex. 8 | 2.7 | 7.9 | 4100 | 1 | 5.2 | Poor *3 |

Note Feeling
Poor *2: Poor in resilience bounce and pile stability against compression
Poor *3: Fabric surface was easily whitened by friction
F. good: Fairly good
V. good: Very good
Fiber diameter reduction (%): $[(D_1 - D_2)/D_2] \times 100$
Rate *4: Rate of moisture absorption (%/5 minutes)
Equi. *5: Equilibrium Moisture Content (%)

What is claimed is:

1. A hygroscopic polyamide fiber exhibiting a rate of moisture absorption of at least 3.5%/5 minutes at a temperature of 25° C. and a relative humidity of 90%; said polyamide fiber being made by removing by means of dissolution at least a part of a polyalkylene glycol (B) from a polyamide fiber comprising:

(A) a thermoplastic aliphatic polyamide having a melting point of at least 160° C. and having copolymerized therein a polyalkylene oxide unit having a number average molecular weight of 2,000 to 8,000; the amount of the polyalkylene oxide unit being 3 to 15% by weight based on the weight of the polyamide into which the polyalkylene oxide unit is to be copolymerized, and (B) 5 to 40% by weight, based on the weight of the ingredient (A), of said polyoxyalkylene glycol; said ingredient (B) having a number average molecular weight of 6,000 to 20,000 and being finely dispersed in the ingredient (A).

2. The polyamide fiber according to claim 1, wherein the polyalkylene oxide unit is selected from the group consisting of a polyethylene oxide unit, a polypropylene oxide unit and a polyethylene/propylene oxide unit.

3. An antistatic polyamide fiber exhibiting a triboelectric voltage of not larger than 1.5 kV at a temperature of 20° C. and a relative humidity of 40%; said polyamide fiber being made by removing by means of dissolution at least a part of a polyalkylene glycol (B) from a polyamide fiber comprising:

(A) a thermoplastic aliphatic polyamide having a melting point of at least 160° C. and having copolymerized therein a polyalkylene oxide unit having a number average molecular weight of 2,000 to 8,000; the amount of the polyalkylene oxide unit being 3 to 15% by weight based on the weight of the polyamide into which the polyalkylene oxide unit is to be copolymerized, and (B) 5 to 40% by weight, based on the weight of the ingredient (A), of said polyoxyalkylene glycol; said ingredient (B) having a number average molecular weight of 6,000 to 20,000 and being finely dispersed in the ingredient (A).

4. The polyamide fiber according to claim 3, wherein the polyalkylene oxide unit is selected from the group consisting of a polyethylene oxide unit, a polypropylene oxide unit and a polyethylene/propylene oxide unit.

* * * * *